US009866965B2

(12) United States Patent
Friedlander et al.

(10) Patent No.: US 9,866,965 B2
(45) Date of Patent: Jan. 9, 2018

(54) AUTO-CONFIGURABLE SPEAKER SYSTEM

(71) Applicant: SONY CORPORATION, Tokyo (JP)

(72) Inventors: Steven Friedlander, Escondido, CA (US); David Young, San Diego, CA (US); Hyehoon Yi, Escondido, CA (US); Marvin Demerchant, San Diego, CA (US)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/018,681

(22) Filed: Feb. 8, 2016

(65) Prior Publication Data

US 2017/0230753 A1 Aug. 10, 2017

(51) Int. Cl.
*H04R 5/04* (2006.01)

(52) U.S. Cl.
CPC ..... *H04R 5/04* (2013.01); *H04R 2420/05* (2013.01); *H04R 2420/07* (2013.01)

(58) Field of Classification Search
CPC ... H04R 5/04; H04R 2420/05; H04R 2420/07
See application file for complete search history.

(56) References Cited

U.S. PATENT DOCUMENTS 6,738,318 B1 * 5/2004 Harris ..... G06F 9/5072 369/2
7,483,538 B2 1/2009 Mccarty et al.
8,325,935 B2 * 12/2012 Rutschman ..... H04M 1/6066 348/554
8,610,310 B2 * 12/2013 Lockett ..... H04N 7/163 307/104
8,638,957 B2 1/2014 Sim et al.
8,952,824 B2 2/2015 Drimusz et al.
9,294,840 B1 * 3/2016 Anderson ..... H04R 5/00
2005/0026560 A1 * 2/2005 Villaverde ..... H04M 1/6066 455/3.06
2005/0177256 A1 * 8/2005 Shintani ..... H04R 27/00 700/94
2013/0301861 A1 11/2013 Ho et al.
2013/0315417 A1 11/2013 Christie
(Continued)

FOREIGN PATENT DOCUMENTS

CN 203039881 U * 7/2013
CN 203851277 U * 9/2014
(Continued)

OTHER PUBLICATIONS

Office Action for KR Patent Application No. 10-2017-0015631, dated Aug. 28, 2017, 5 pages of Office Action and 3 pages of English Translation.

*Primary Examiner* — Brenda Bernardi
(74) *Attorney, Agent, or Firm* — Chip Law Group

(57) ABSTRACT

Various aspects of a speaker system and a method for auto-configuration of the speaker system is disclosed herein. The speaker system includes an electronic device, which reproduce a first audio in a first speaker configuration. A first sound reproduction device is detected within a pre-defined range of the electronic device. Based on the detection, the first audio is communicated to the first sound reproduction device by the electronic device. The first speaker configuration is modified to a second speaker configuration to reproduce the communicated first audio at the first sound reproduction device.

20 Claims, 10 Drawing Sheets

(56) References Cited

U.S. PATENT DOCUMENTS

| | | | | |
|---|---|---|---|---|
| 2013/0324031 | A1 | 12/2013 | Loureiro | |
| 2015/0163616 | A1* | 6/2015 | Chatterjee | H04S 7/301 381/303 |
| 2015/0195051 | A1* | 7/2015 | Hutchings | G01S 5/0257 455/41.3 |
| 2015/0264504 | A1 | 9/2015 | Yeo et al. | |
| 2015/0296282 | A1* | 10/2015 | Fujioka | H04R 1/02 381/79 |
| 2016/0142821 | A1* | 5/2016 | Lin | H04R 3/12 381/80 |
| 2016/0196030 | A1* | 7/2016 | Kim | G06F 3/0488 715/781 |
| 2016/0249153 | A1* | 8/2016 | Nielsen | H04S 7/301 |

FOREIGN PATENT DOCUMENTS

| | | | |
|---|---|---|---|
| KR | 10-2015-0106649 | A | 9/2015 |
| WO | 2013103290 | A | 7/2013 |

* cited by examiner

AUTO-CONFIGURABLE SPEAKER SYSTEM

CROSS-REFERENCE TO RELATED APPLICATIONS/INCORPORATION BY REFERENCE

None.

FIELD

Various embodiments of the disclosure relate to a speaker system. More specifically, various embodiments of the disclosure relate to an auto-configurable speaker system.

BACKGROUND

With advancements in multi-channel audio technologies, various configuration of speaker systems have become popular in recent years. Currently, speaker systems are provided in various manufacturer specified configurations, such as a 2.1, a 5.1, or a 7.1 speaker configuration, or as separate portable speaker devices. A user may have limited or no option to change the manufacturer specified configuration of a speaker system once the speaker system is purchased. For example, a user may purchase a speaker system with a pre-specified configuration. The speaker system in the pre-specified configuration may include a portable speaker and a central speaker system. In certain scenarios, the user may want the portable speaker to work independently of the central speaker system, which may be difficult to set up. In certain other scenarios, the user may want to convert the manufacturer specified configuration of the speaker system to a multi-room speaker system. However, such configurations may be difficult to set up for a naïve user. Consequently, an advanced, auto-configurable, and a multi-purpose speaker system may be required.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

A speaker system and a method for auto-configuration of the speaker system is provided substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Figure 1:
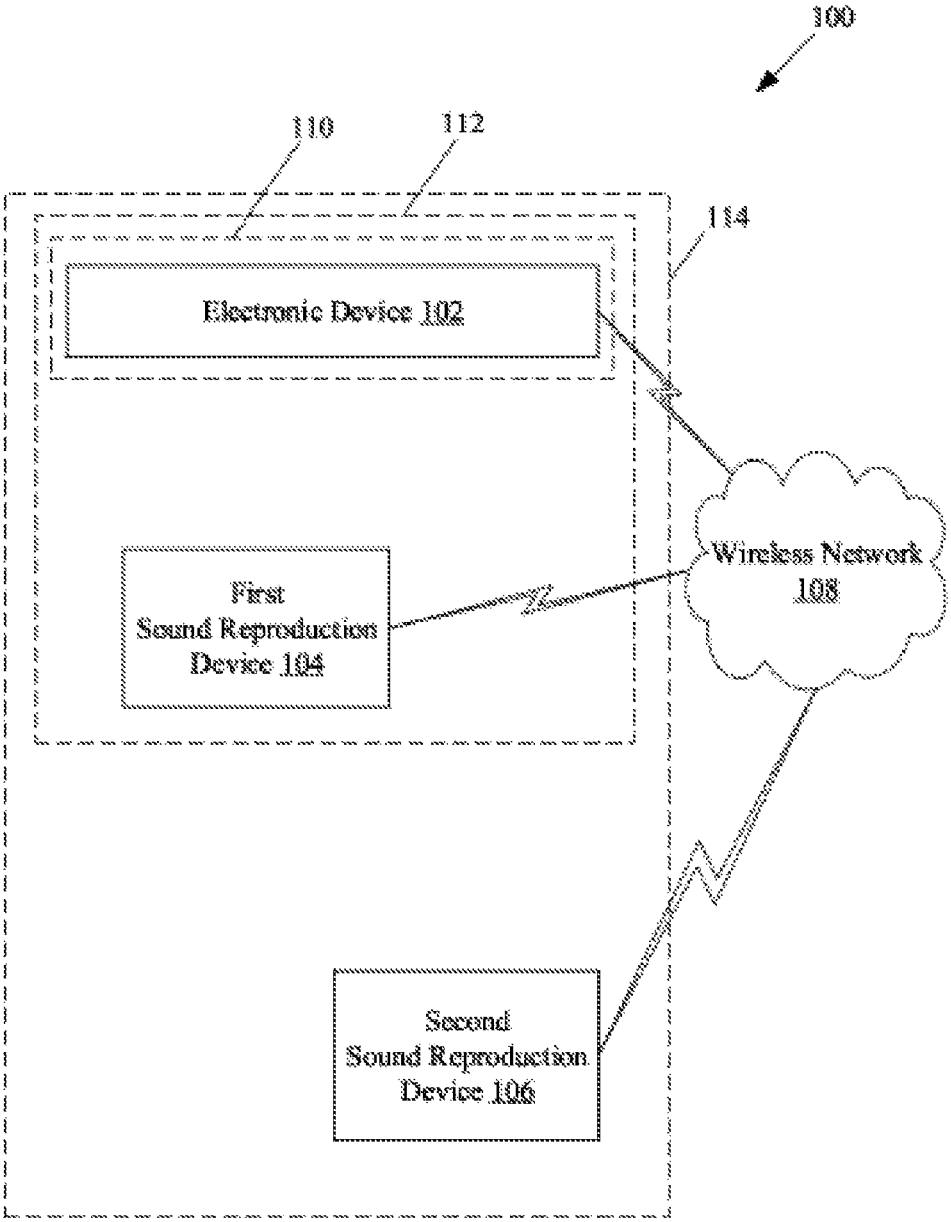
FIG. 1 is a block diagram that illustrates an exemplary network environment, in accordance with an embodiment of the disclosure.

The following described implementations may be found in the disclosed speaker system and method for auto-configuration of the speaker system. Exemplary aspects of the disclosure may include an electronic device, which may reproduce a first audio in a first speaker configuration. A first sound reproduction device may be detected within a pre-defined range of the electronic device. Based on the detection, the first audio may be communicated to the first sound reproduction device by the electronic device. The first speaker configuration may be modified to a second speaker configuration to reproduce the communicated first audio at the first sound reproduction device.

In accordance with an embodiment, the electronic device may correspond to a central speaker, a sound bar, and/or a central control device. The first sound reproduction device may correspond to a side speaker, a digital speaker, a loudspeaker, and/or a portable sound reproduction device. The first speaker configuration may correspond to a first multi-channel audio system configuration. The second speaker configuration may correspond to a second multi-channel audio system configuration.

In accordance with an embodiment, a first audio calibration may be performed in the second speaker configuration by the electronic device. The first audio calibration may be performed based on a current position of the first sound reproduction device. A first calibration setting may be communicated to the first sound reproduction device for the first audio calibration.

In accordance with an embodiment, a second audio calibration may be performed in the second speaker configuration by the electronic device. The second audio calibration may be performed when the first sound reproduction device is moved to a new position. A second calibration setting may be communicated to the first sound reproduction device for the second audio calibration.

In accordance with an embodiment, the movement of the first sound reproduction device may correspond to a change in position of the first sound reproduction device with respect to the electronic device in a first room space. In accordance with an embodiment, the movement of the first sound reproduction device may further correspond to a change in position of the first sound reproduction device from the first room space to a second room space. The first sound reproduction device and the electronic device may function as a unified multi-channel audio system based on the second audio calibration.

In accordance with an embodiment, when the first sound reproduction device is detected within the pre-defined range of the electronic device, the electronic device may connect to the first sound reproduction device. Such connection may be established via a wireless communication protocol. In accordance with an embodiment, a second sound reproduction device may be detected within the pre-defined range of the electronic device. In such a case, the electronic device may connect to the second sound reproduction device, via the wireless communication protocol.

In accordance with an embodiment, the first audio may be communicated simultaneously to the first sound reproduction device and the second sound reproduction device by the electronic device. The second speaker configuration may be modified to a third speaker configuration to reproduce the communicated first audio at the first sound reproduction device and second sound reproduction device.

In accordance with an embodiment, the first audio may be communicated to the first sound reproduction device and a second audio may be communicated to the second sound reproduction device, by the electronic device. The second speaker configuration may be modified to a third speaker configuration. The modification may occur to reproduce the communicated first audio at the first sound reproduction device and the second audio at the second sound reproduction device.

In accordance with an embodiment, when the first sound reproduction device is disconnected from the electronic device, an auto-reconfiguration to first speaker configuration, may be performed. The first sound reproduction device may be wirelessly recharged by the electronic device. The first sound reproduction device may include a rechargeable power bank.

FIG. 1 is a block diagram that illustrates an exemplary network environment, in accordance with an embodiment of the disclosure. With reference to FIG. 1, there is shown a network environment 100. The network environment 100 may include an electronic device 102 and one or more sound reproduction devices, such as a first sound reproduction device 104 and a second sound reproduction device 106. There is further shown a wireless network 108 and one or more speaker configurations, such as a first speaker configuration 110, a second speaker configuration 112, and a third speaker configuration 114. In accordance with an embodiment, the electronic device 102 may communicate with the first sound reproduction device 104 and/or the second sound reproduction device 106, via the wireless network 108.

The electronic device 102 may comprise suitable circuitry and/or interfaces that may be configured to detect the first sound reproduction device 104 and/or the second sound reproduction device 106. In accordance with an embodiment, the electronic device 102 may include one or more speaker drivers. Examples of the electronic device 102 may include, but are not limited to, a sound bar, a central speaker, a central control device, a digital speaker, a plasma speaker, and/or a wireless speaker.

The one or more sound reproduction devices, such as the first sound reproduction device 104 and the second sound reproduction device 106, may comprise suitable circuitry and/or interfaces that may be configured to receive audio data from the electronic device 102. The one or more sound reproduction devices may be configured to convert a digital or an electrical signal into an audible sound. Examples of the first sound reproduction device 104 and the second sound reproduction device 106, may include, but are not limited to, a portable sound reproduction device, a side speaker, a loudspeaker, a subwoofer, an electrostatic speaker, a planar-magnetic speaker, a ceiling speaker, a standing speaker, a surface mount speaker, a column speaker, and/or a portable wireless speaker.

The wireless network 108 may include a medium through which the electronic device 102 may communicate with the first sound reproduction device 104 and the second sound reproduction device 106. Examples of the wireless network 108 may include, but are not limited to, a Wireless Fidelity (Wi-Fi) network, and/or a wireless wide area network (WAN). Various devices in the network environment 100 may be configured to connect to the wireless network 108, in accordance with various wireless communication protocols. Examples of such wireless communication protocols may include, but are not limited to, Transmission Control Protocol and Internet Protocol (TCP/IP), User Datagram Protocol (UDP), Hypertext Transfer Protocol (HTTP), File Transfer Protocol (FTP), ZigBee, EDGE, IEEE 802.11, Light Fidelity (Li-Fi), 802.16, IEEE 802.11s, IEEE 802.11g, multi-hop communication, wireless access point (AP), device to device communication, cellular communication protocols, and/or Bluetooth (BT) communication protocols.

The one or more speaker configurations, such as the first speaker configuration 110, the second speaker configuration 112, and the third speaker configuration 114, may correspond to a multi-channel audio system configuration. The multi-channel audio system configuration may be referred to as a "(2+n).1" speaker configuration, where "n" is a whole number. For example, the one or more speaker configurations, may be a 2.1, 3.1, 4.1, 5.1, 6.1, 7.1, speaker configuration, and so on.

In operation, the electronic device 102 may be configured to reproduce a first audio in the first speaker configuration 110, such as a 5.1 speaker configuration. Notwithstanding, the electronic device 102 may also correspond to a speaker system with "(2+n).1" speaker configuration, without limiting the scope of the disclosure. The electronic device 102 may be configured to detect the first sound reproduction device 104 within a pre-defined range of the electronic device 102. Based on the detection, the electronic device 102 may be configured to connect to the first sound reproduction device 104. The connection may be established within the pre-defined range by use of a wireless communication protocol, such as Wi-Fi communication protocol, in the wireless network 108.

In accordance with an embodiment, the electronic device 102 may be configured to communicate the first audio to the first sound reproduction device 104, via the wireless network 108. The electronic device 102 may be configured to modify the first speaker configuration 110 to the second speaker configuration 112. For example, when the first speaker configuration 110 is the 5.1 speaker configuration, the 5.1 speaker configuration may be modified to a 6.1 speaker configuration (such as "(2+n+1).1" speaker configuration).

In accordance with an embodiment, the electronic device 102 may be configured to detect a position of the first sound reproduction device 104 in the second speaker configuration 112. Based on the detected position of the first sound reproduction device 104, the electronic device 102 may be configured to generate a first calibration setting for the first sound reproduction device 104 in the second speaker configuration 112. The electronic device 102 may be configured to communicate the generated first calibration setting to the first sound reproduction device 104 in the second speaker configuration 112.

In accordance with an embodiment, the electronic device 102 may be configured to perform a first audio calibration in the second speaker configuration 112, based on the detected position of the first sound reproduction device 104. The first audio calibration may be performed at the electronic device 102 and/or the first sound reproduction device 104.

The first sound reproduction device 104 and the electronic device 102 may function as a unified multi-channel audio system, such as a surround sound multi-channel audio system, in the second speaker configuration 112. In accordance with an embodiment, the first sound reproduction device 104 may include a rechargeable power bank. The electronic device 102 may be configured to wirelessly charge the first sound reproduction device in the second speaker configuration 112. The wireless charging may be performed based on inductive charging, sound waves based charging, or the like, known in the art.

In accordance with an embodiment, the first sound reproduction device 104 may be disconnected from the electronic device 102. In such a case, the electronic device 102 may be configured to perform an auto-reconfiguration back to the first speaker configuration 110. In accordance with an embodiment, the electronic device 102 may be configured to detect a change in position of the first sound reproduction device 104 with respect to the position of the electronic device 102. In accordance with an embodiment, the change in position of the first sound reproduction device 104 may be detected in the pre-defined range of the electronic device 102.

In accordance with an embodiment, the electronic device 102 may be configured to communicate a second calibration setting to the first sound reproduction device 104 in the second speaker configuration 112. The second calibration setting may be communicated when the change in position of the first sound reproduction device 104 is detected. For example, both the electronic device 102 and the first sound reproduction device 104 may be in a first room space (a same room). The first sound reproduction device 104 may be moved to a new position in the first room space. In another example, the first sound reproduction device 104 may be moved from the first room space to a second room space (such as a different room). The electronic device 102 may be configured to detect and differentiate such change in position of the first sound reproduction device 104 within the same room or different room with respect to the electronic device 102.

In accordance with an embodiment, the electronic device 102 may be configured to perform a second audio calibration in the second speaker configuration 112, based on the movement of the first sound reproduction device 104 to the new position. The first sound reproduction device 104 may still function as the unified multi-channel audio system in association with the electronic device 102 after such movement.

In accordance with an embodiment, the electronic device 102 may be configured to detect the second sound reproduction device 106 within the pre-defined range of the electronic device 102. For instance, a user may enter the first room space that may be within the pre-defined range, such as the wireless network 108 range, of the electronic device 102. Based on the detection, the electronic device 102 may connect to the second sound reproduction device 106, via the wireless communication protocol (such as Wi-Fi) in the wireless network 108.

In accordance with an embodiment, the electronic device 102 may be configured to communicate the first audio simultaneously to the first sound reproduction device 104 and the second sound reproduction device 106. The first audio may be the same audio reproduced at the electronic device 102. The electronic device 102 may be configured to dynamically modify the second speaker configuration 112 to the third speaker configuration 114. The second speaker configuration 112 may be modified for simultaneous reproduction of the communicated first audio at the first sound reproduction device 104 and the second sound reproduction device 106. For example, a same music may be played at the electronic device 102, the first sound reproduction device 104, and/or the second sound reproduction device 106.

In accordance with an embodiment, the electronic device 102 may be further configured to communicate the first audio at the first sound reproduction device 104 and a second audio at the second sound reproduction device 106. The first sound reproduction device 104 may reproduce the first audio communicated by the electronic device 102. The second sound reproduction device 106 may reproduce the second audio communicated by the electronic device 102. The second audio may be different from the first audio in the third speaker configuration 114, such as a 7.1 speaker configuration. For example, the electronic device 102 and the first sound reproduction device 104 may play a same music. Whereas, the second sound reproduction device 106 may play a different music streamed by the electronic device 102, in the third speaker configuration 114.

Figure 2:
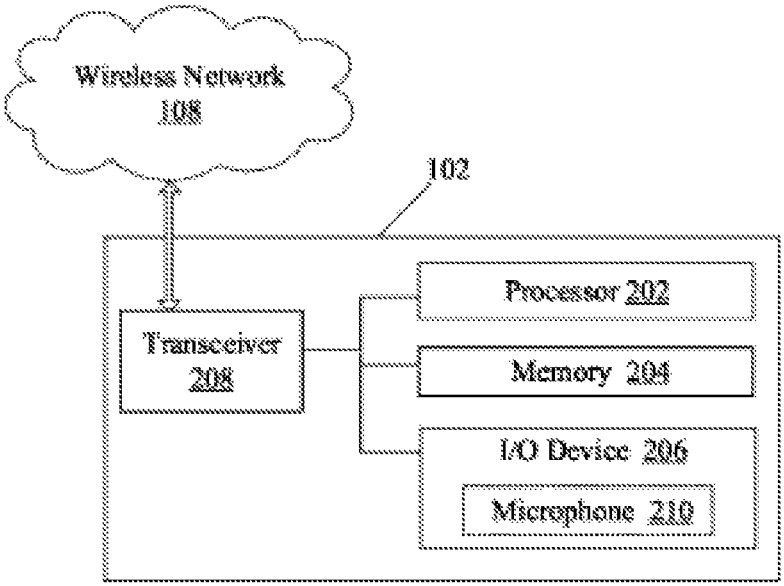
FIG. 2 is a block diagram that illustrates an exemplary electronic device, in accordance with an embodiment of the disclosure.

FIG. 2 is a block diagram that illustrates an exemplary electronic device, in accordance with an embodiment of the disclosure. FIG. 2 is explained in conjunction with elements from FIG. 1. With reference to FIG. 2, there is shown the electronic device 102. The electronic device 102 may include one or more processors, such as a processor 202, a memory 204, an I/O device 206, and a transceiver 208. In accordance with an embodiment, the I/O device 206 may include a microphone 210. The processor 202 may be communicatively coupled to the memory 204, the I/O device 206, and the transceiver 208. The transceiver 208 may be configured to communicate with the one or more sound reproduction devices, such as the first sound reproduction device 104 and/or the second sound reproduction device 106, under the control of the processor 202. The communication may occur via the wireless network 108.

The processor 202 may comprise suitable logic, circuitry, interfaces, and/or code that may be configured to execute a set of instructions stored in the memory 204. The processor 202 may be implemented based on a number of processor technologies known in the art. Examples of the processor 202 may be an X86-based processor, a Reduced Instruction Set Computing (RISC) processor, an Application-Specific Integrated Circuit (ASIC) processor, a Complex Instruction Set Computing (CISC) processor, a microprocessor, a central processing unit (CPU), and/or other processors or control circuits.

The memory 204 may comprise suitable logic, circuitry, and/or interfaces that may be configured to store a set of instructions executable by the processor 202. The memory 204 may further be operable to store operating systems and associated applications. Examples of implementation of the memory 204 may include, but are not limited to, Random Access Memory (RAM), Read Only Memory (ROM), Electrically Erasable Programmable Read-Only Memory (EEPROM), Hard Disk Drive (HDD), a Solid-State Drive (SSD), a CPU cache, and/or a Secure Digital (SD) card.

The I/O device 206 may comprise suitable logic, circuitry, interfaces, and/or code that may be configured to receive an input from a user or another electronic device. The I/O device 206 may be further configured to provide an output to the user. The I/O device 206 may comprise various input and output devices that may be configured to communicate with the processor 202. Examples of the input devices may include, but are not limited to, a touch screen, a keyboard, a mouse, a joystick, the microphone 210, a camera, a motion sensor, a light sensor, a proximity sensor, a signal-strength sensor, an infrared sensor, and/or docking pins or a docking station. Examples of the output devices may include, but are not limited to a display screen, and/or one or more speaker drivers.

The transceiver 208 may comprise suitable logic, circuitry, interfaces, and/or code that may be configured to communicate with the one or more sound reproduction devices, such as the first sound reproduction device 104 and/or the second sound reproduction device 106, via the wireless network 108. The transceiver 208 may implement known technologies to support wireless communication of the electronic device 102 in the wireless network 108. The transceiver 208 may include, but is not limited to, an antenna, a radio frequency (RF) transceiver, one or more amplifiers, a tuner, one or more oscillators, a digital signal processor, a coder-decoder (CODEC) chipset, a subscriber identity module (SIM) card, and/or a local buffer. The transceiver 208 may communicate via wireless communication with networks, such as the Internet, an Intranet and/or a wireless network, such as a cellular telephone network, and/or a wireless local area network (WLAN). The wireless communication may use any of a plurality of communication standards, protocols and technologies, such as Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (such as IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS).

The microphone 210 may comprise suitable logic, circuitry, interfaces, and/or code that may be configured to receive voice input or capture sound waves from the one or more sound reproduction devices. The microphone 210, and certain sensors, such as the proximity sensor and the signal-strength sensor, of the I/O device 206 may be utilized by the processor 202 for various audio calibration purposes.

In operation, the processor 202 may be configured to receive an input to reproduce a first audio in the first speaker configuration 110. The first audio may be pre-stored in the memory 204 or retrieved from a plurality of audio sources. The plurality of audio sources may be one or more other electronic devices, such as a television (TV), a mobile device, a multimedia player, and/or such multimedia devices communicatively coupled to the electronic device 102.

In accordance with an embodiment, the plurality of audio sources may be one or more internal (such as the memory 204) or external storage devices, such as a pen drive, a portable hard drive, and/or other storage devices. The processor 202 may be configured to receive or retrieve the first audio from the plurality of audio sources and reproduce the first audio in the first speaker configuration 110. The plurality of audio sources may further correspond to online audio content, such as music libraries, available over the Internet. The processor 202 may be configured to reproduce the first audio in the first speaker configuration 110.

In accordance with an embodiment, the processor 202 may be configured to detect the first sound reproduction device 104 within the pre-defined range of the electronic device 102. Based on the detection, the processor 202 may be configured to connect to the first sound reproduction device 104. The connection may be established within the pre-defined range by use of a wireless communication protocol, such as Wi-Fi communication protocol, in the wireless network 108.

In accordance with an embodiment, the processor 202 may be configured to communicate the first audio to the first sound reproduction device 104, via the wireless network 108. The processor 202 may be configured to modify the first speaker configuration 110 to the second speaker configuration 112. In accordance with an embodiment, the processor 202 may be configured to determine a suitable positioning of the first sound reproduction device 104 and/or the second sound reproduction device 106 with respect to the electronic device 102. The suitable positioning may be determined based on a time alignment between the electronic device 102, the first sound reproduction device 104 and/or the second sound reproduction device 106. The suitable positioning may be further determined based on a directivity of the first audio in a room space. In accordance with an embodiment, the functionalities or operations performed by the electronic device 102, as described in FIG. 1, may performed by the processor 202. Other operations performed by the processor 202 may be understood from the description in the FIGS. 4A, 4B, 5A, 5B, 5C, and 6A to 6C.

Figure 3:
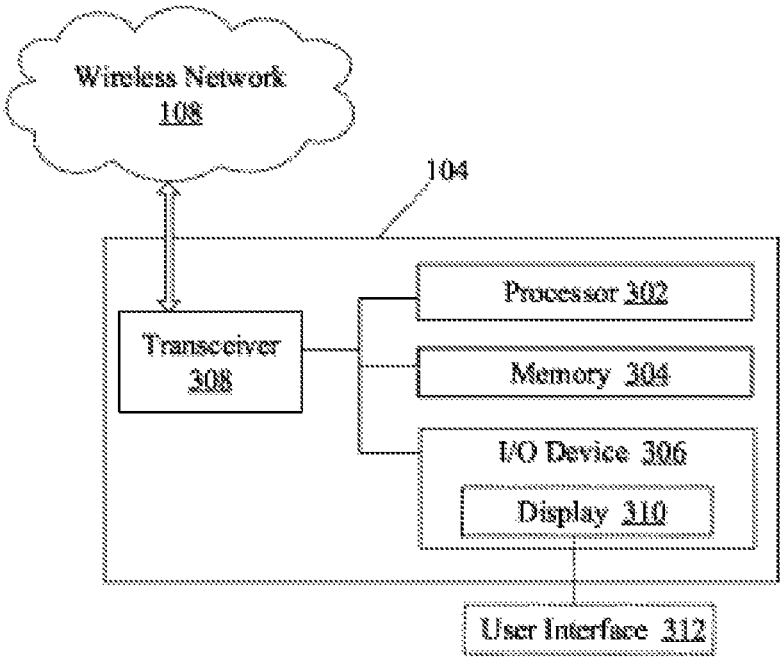
FIG. 3 is a block diagram that illustrates an exemplary sound reproduction device, in accordance with an embodiment of the disclosure.

FIG. 3 is a block diagram that illustrates an exemplary sound reproduction device, in accordance with an embodiment of the disclosure. FIG. 3 is explained in conjunction with elements from FIG. 1 and FIG. 2. With reference to FIG. 3, there is shown the first sound reproduction device 104. The first sound reproduction device 104 may include one or more processors, such as a processor 302, a memory 304, an I/O device 306, and a transceiver 308. In accordance with an embodiment, I/O device 306 may include a display screen 310. There is further shown a user interface (UI) 312 rendered on the display screen 310.

In accordance with an embodiment, the processor 302 may be communicatively coupled to the memory 304, the I/O device 306, and the transceiver 308. The transceiver 308 may be configured to communicate with the electronic device 102, via the wireless network 108, under the control of the processor 202. In accordance with an embodiment, examples of implementation of the processor 302, the memory 304, the I/O device 306, and the transceiver 308 may be similar to implementation of the processor 202, the memory 204, the I/O device 206, and the transceiver 208 respectively (FIG. 2).

The display screen 310 may be configured to display the UI 312. The display screen 310 may be further configured to render one or more features and/or applications of the first sound reproduction device 104. Examples of the display screen 310 may include, but are not limited to, a liquid crystal display (LCD), a light emitting diode (LED), a electroluminescent display (ELD), a plasma display panel (PDP), an organic light emitting diode display (OLED), a field emission display (FED), a thin film transistor display (TFT), and/or other such displays.

The UI 312 may be a visual interface that may facilitate the user to interact with one or more applications and/or operating systems of the first sound reproduction device 104. The UI 312 may be a graphical user interface (GUI) that may include graphical controls, such as a menu bar, a toolbar, a window, a button, and other such controls to operate the first sound reproduction device 104.

In operation, the processor 302 may be configured to establish a communicative coupling with the electronic device 102 in the wireless network 108. The processor 302 may be configured to receive a first audio communicated from the electronic device 102, by use of the transceiver 308. The processor 302 may be configured to receive one or more instructions from the electronic device 102 to operate as a unified multi-channel audio system in association with the electronic device 102. In other words, the first sound reproduction device 104 may be added to the first speaker configuration 110 of the electronic device 102 to work as the unified multi-channel audio system.

In accordance with an embodiment, the processor 302 may be configured to receive a first calibration setting from the electronic device 102. The one or more instructions that may include the first calibration setting may be received when the first sound reproduction device 104 may be moved within the pre-defined range of the electronic device 102. The first calibration setting may be based on the current position of the first sound reproduction device 104 as detected by the electronic device 102. The addition or inclusion of the first sound reproduction device 104 in the first speaker configuration 110 may result in a modified speaker configuration, such as the second speaker configuration 112. The received first audio may then be reproduced, by use of the I/O device 306, at the first sound reproduction device 104.

In accordance with an embodiment, the electronic device 102 and the first sound reproduction device 104 may be located in a same room, such as a first room space, to work as the unified multi-channel audio system. In certain scenarios, a user may move the first sound reproduction device 104 in the first room space. The processor 302 may be configured to receive a second calibration setting from the electronic device 102, by use of the transceiver 308. The second calibration setting may be received when the position of the first sound reproduction device 104 with respect to the electronic device 102 may be changed in the first room space. The second calibration setting may be received for second audio calibration in the second speaker configuration 112.

In certain other scenarios, the user may move the first sound reproduction device 104 from the first room space to a second room space. In such a case, the processor 302 may be configured to receive the second calibration setting in accordance with the changed position of the first sound reproduction device 104. The first sound reproduction device 104 may function as the unified multi-channel audio system in association with the electronic device 102 in the second room space. The first sound reproduction device 104 may continue to reproduce the same audio, such as the first audio, as reproduced by the electronic device 102. The first sound reproduction device 104 may reproduce the first audio in the second room space in accordance with the received second calibration setting. Thus, a multi-room speaker system may be provided.

In accordance with an embodiment, the processor 302 may be configured to receive a second audio from the electronic device 102 while the first audio is reproduced at the electronic device 102. The second audio may be received by use of the transceiver 308. In such a case, the second audio may be reproduced at the first sound reproduction device 104 while the first audio is reproduced at the electronic device 102. Thus, a multi-room speaker system may be provided in a single speaker configuration, such as the second speaker configuration 112, with the ability to play the same audio (same music) or a different audio (different music) for each speaker.

In accordance with an embodiment, the processor 302 may be configured to receive an input from the user by use of the UI 312. The UI 312 may be rendered on the display screen 310 of the first sound reproduction device 104. The input may be a touch-based input on the display screen 310 that may be a touch screen. The memory 304 may be configured to store audio content, such as music, and associated metadata. The processor 302 may be further configured to control display of the pre-stored audio content on the display screen 310, by use of the UI 312. The user may select at least one of the one or more audio content items from the audio content displayed via the UI 312 on display screen 310. The selected audio content item may be played back at the first sound reproduction device 104. In response to the received user input, the playback or reproduction of the selected audio content item may be independent of the electronic device 102. Thus, the first sound reproduction device 104 may function as a separate unit, and may be disconnected with the electronic device 102. In accordance with an embodiment, the second sound reproduction device 106 may be similar to the first sound reproduction device 104.

Figure 4A:
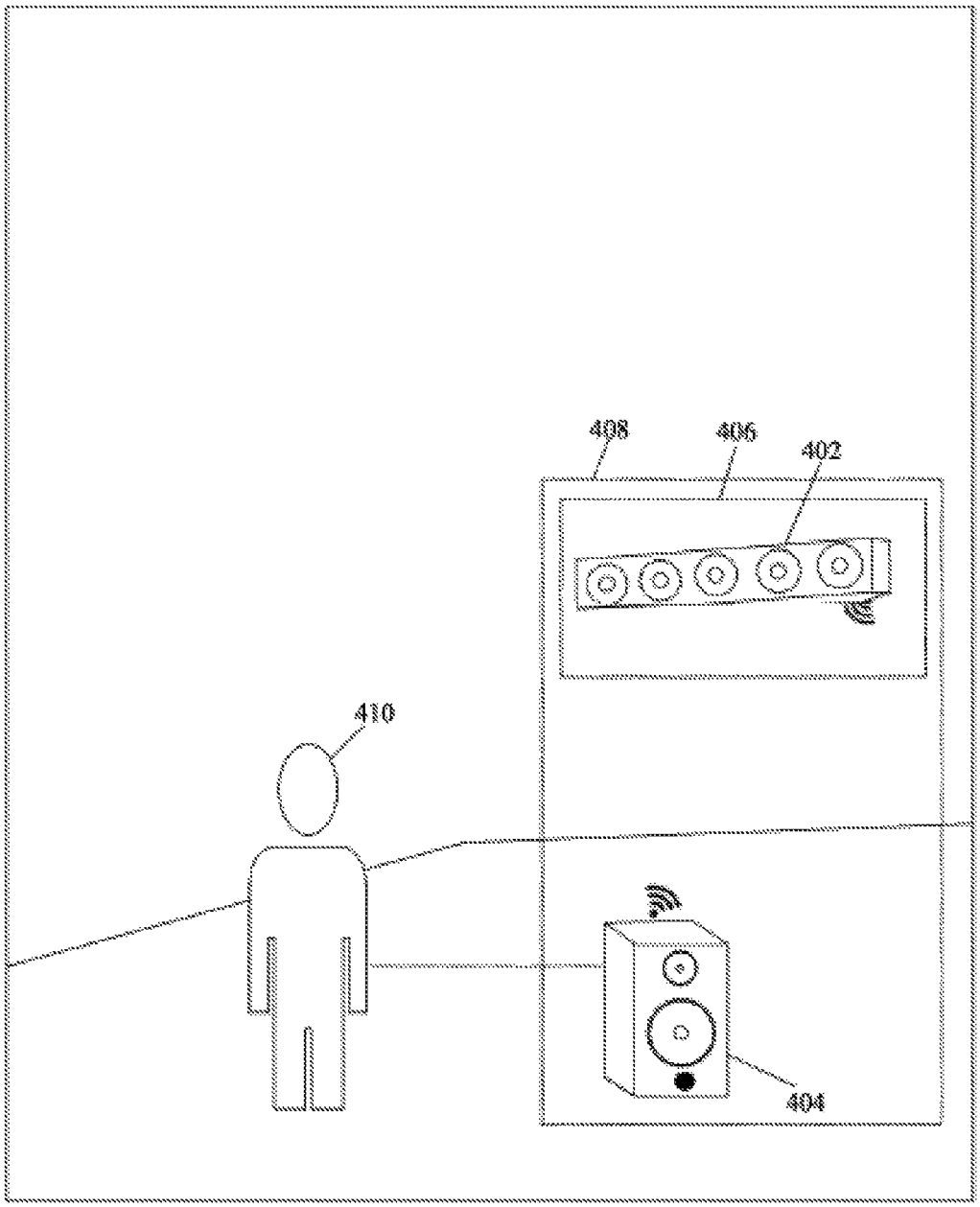
FIGS. 4A and 4B, collectively, illustrate a first exemplary scenario for implementation of the disclosed speaker system, in accordance with an embodiment of the disclosure.
Figure 4B:
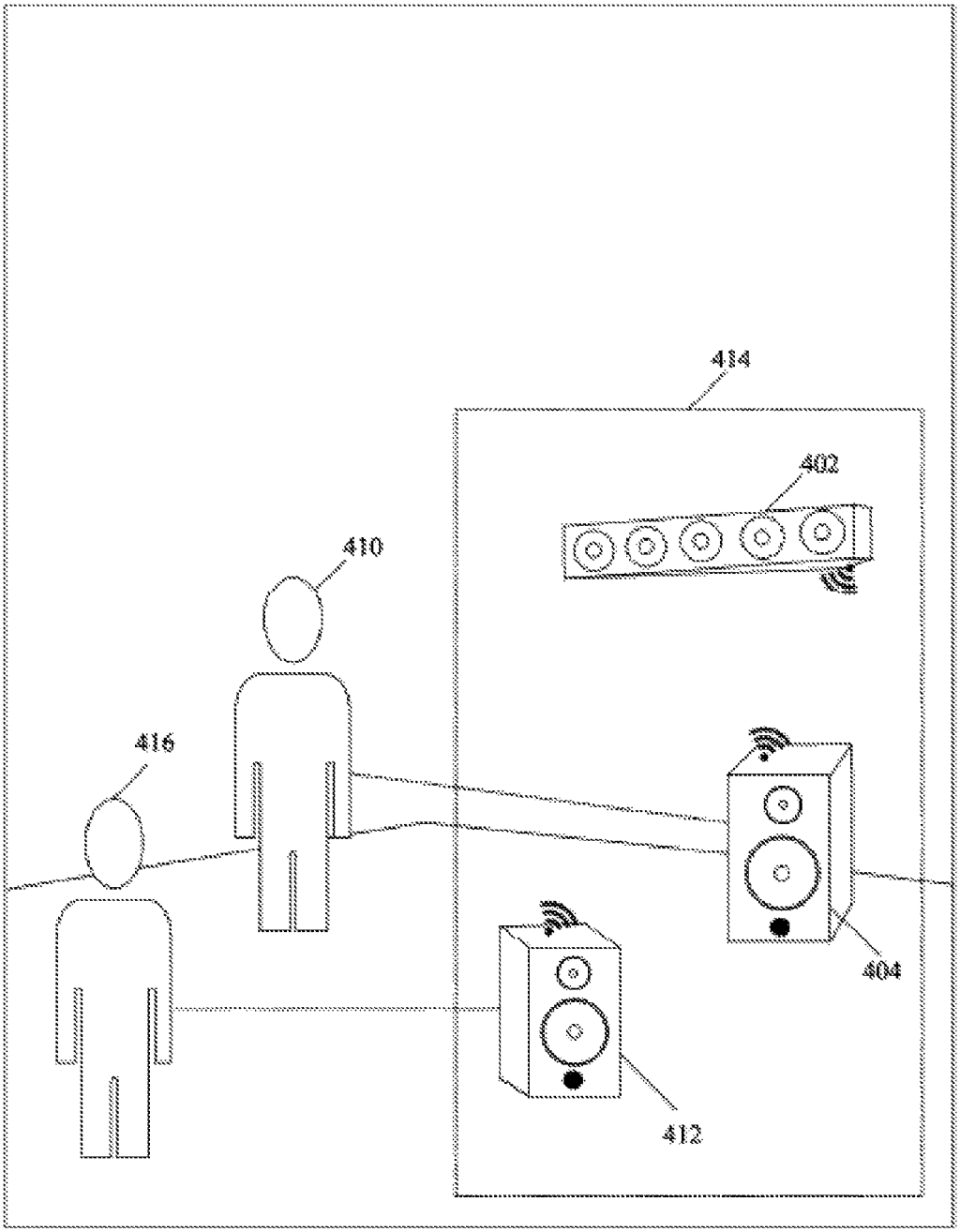

FIGS. 4A and 4B collectively illustrate a first exemplary scenario for implementation of the disclosed speaker system, in accordance with an embodiment of the disclosure. FIGS. 4A and 4B are described in conjunction with elements from FIGS. 1, 2, and 3. With reference to FIG. 4A, there is shown a central control device 402, a first speaker 404, a 5.1 speaker configuration 406, a 6.1 speaker configuration 408, and a first user 410.

In accordance with the first exemplary scenario, the central control device 402 may correspond to the electronic device 102. The first speaker 404 may correspond to the first sound reproduction device 104. The central control device 402 may be an auto-configurable speaker system in the 5.1 speaker configuration 406. The 5.1 speaker configuration 406 may correspond to the first speaker configuration 110. The central control device 402 may be installed at a first location and may have a pre-defined wireless range, such as 100 feet. The first location may be a party venue, and accordingly, the central control device 402 may be preset in a party mode. A first music may be reproduced in the central control device 402 in the 5.1 speaker configuration 406. The first user 410 may approach the first location with the first speaker 404. The first speaker 404 may be a personal device of the first user 410. In operation, the central control device 402 may detect the first speaker 404 within the pre-defined range of the central control device 402. Based on the detection of the first speaker 404, the central control device 402 may connect with the first speaker 404. The connection may be established by use of a Wi-Fi communication protocol. The central control device 402 may communicate the first music (then reproduced at the central control device 402) to the first speaker 404.

In accordance with an embodiment, the central control device 402 may dynamically modify the 5.1 speaker configuration 406 to the 6.1 speaker configuration 408 to simultaneously reproduce the first music at the central control device 402 and the first speaker 404. The 6.1 speaker configuration 408 may correspond to the second speaker configuration 112 (FIG. 1).

With reference to 4B, there is further shown a second speaker 412, a 7.1 speaker configuration 414, and a second user 416. There is also shown the central control device 402, the first speaker 404, and the first user 410. The second speaker 412 may correspond to the second sound reproduction device 106. The second user 416 may arrive at the party venue with the second speaker 412.

The central control device 402 may detect the second speaker 412 within the pre-defined range of the central control device 402. A wireless connection may be established between the central control device 402 and the second speaker 412. The central control device 402 may further communicate the first music to the second speaker 412. The central control device 402 may dynamically modify the 6.1 speaker configuration 408 to the 7.1 speaker configuration 414. The 7.1 speaker configuration 414 may correspond to the third speaker configuration 114 (FIG. 1). Thus, it may be possible to auto-configure the central control device 402 from the 5.1 speaker configuration 406 to 6.1 speaker configuration 408, and subsequently to 7.1 speaker configuration 414. All the speakers, such as the central control device 402, the first speaker 404, and the second speaker 412, may play the same music, such as the first music, in the 7.1 speaker configuration 414. The first speaker 404 and the second speaker 412 may receive calibration settings from the central control device 402 based on their current position with respect to the central control device 402.

Figure 5A:
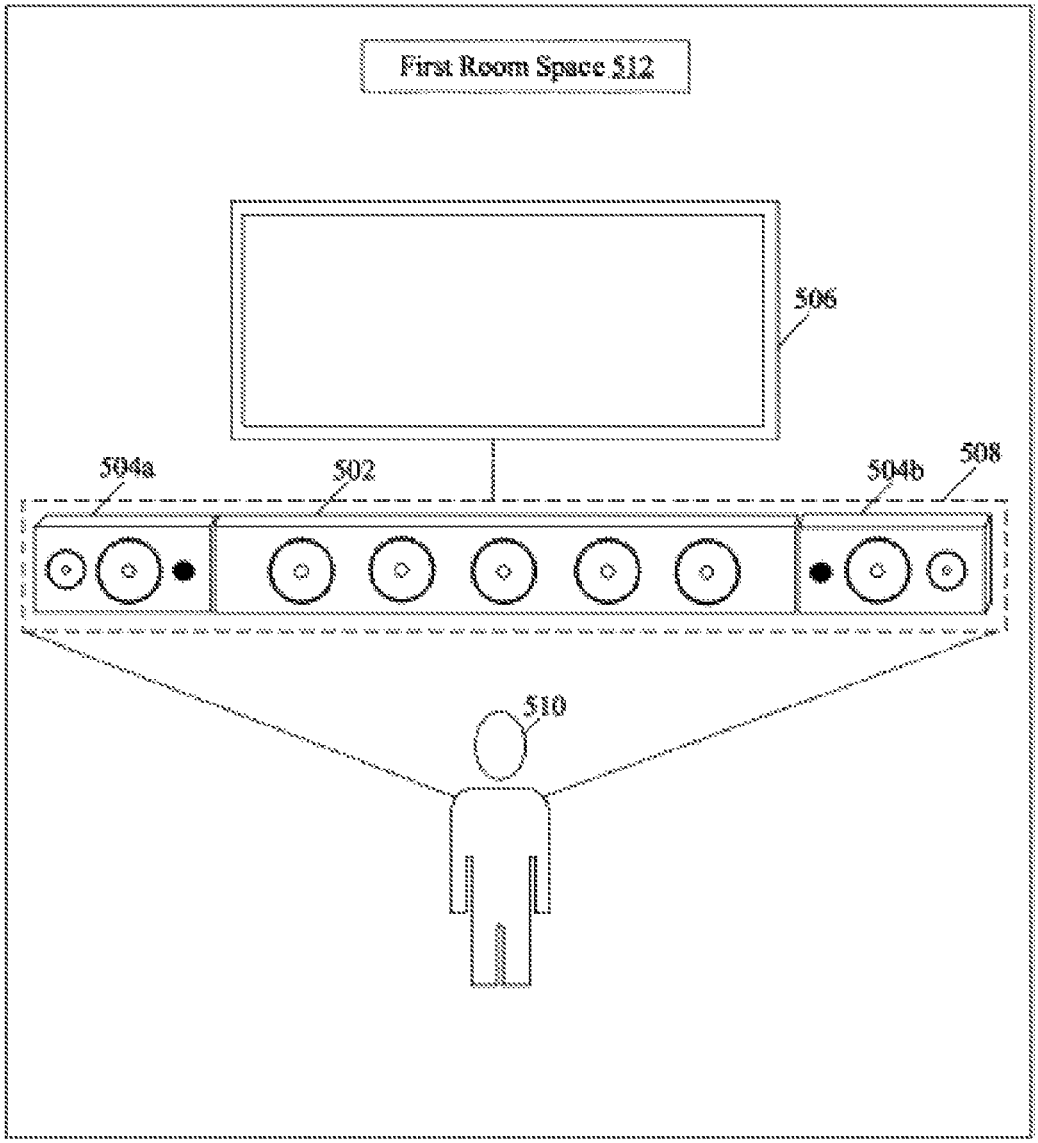
FIGS. 5A to 5C, collectively, illustrate a second exemplary scenario for implementation of the disclosed speaker system, in accordance with an embodiment of the disclosure.
Figure 5B:
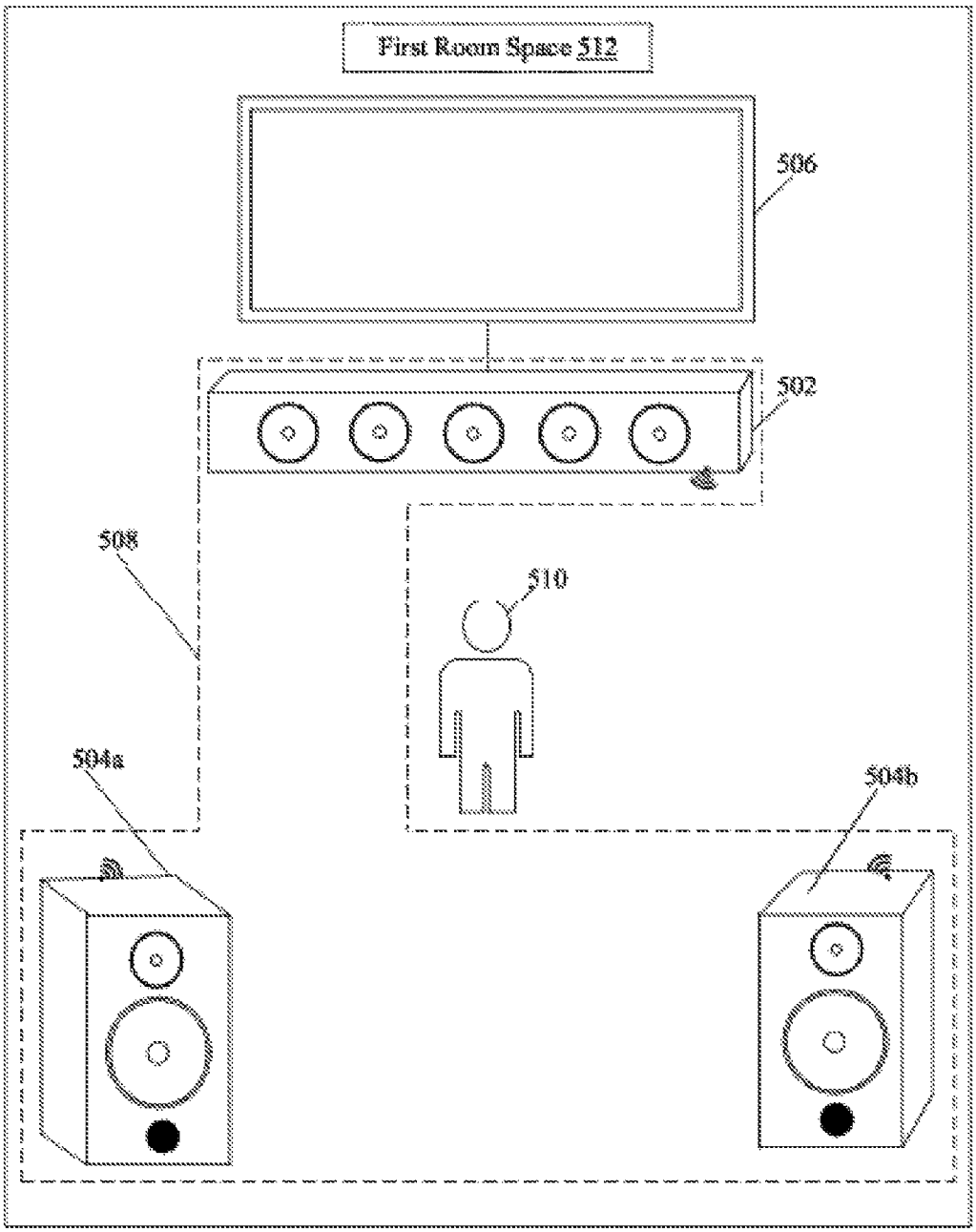
Figure 5C:
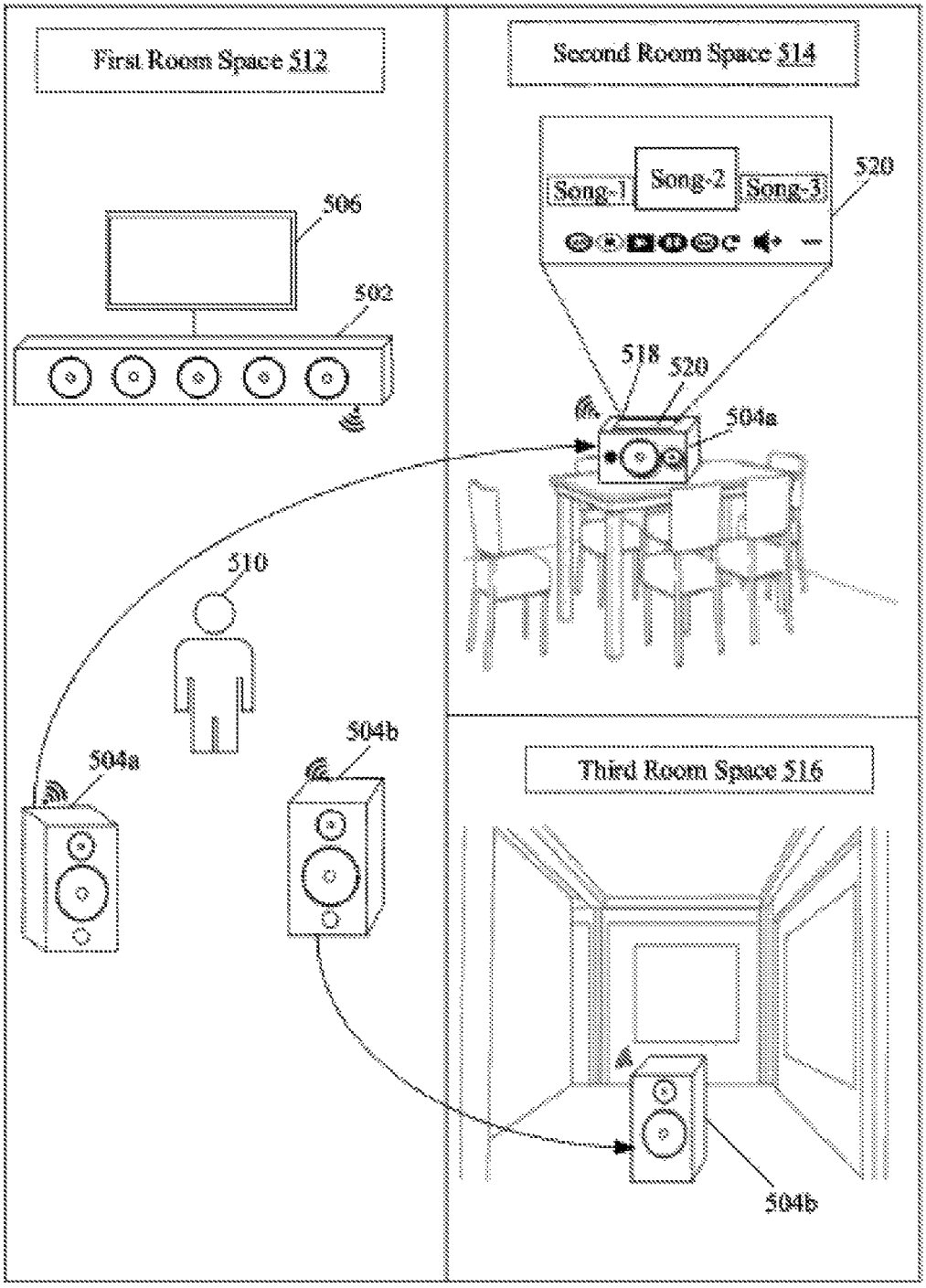

FIGS. 5A to 5C, collectively, illustrate a second exemplary scenario for implementation of the disclosed speaker system, in accordance with an embodiment of the disclosure. FIGS. 5A to 5C are described in conjunction with elements from FIGS. 1 to 3, 4A, and 4B. With reference to FIG. 5A, there is shown a center piece 502, a first side speaker 504*a*, a second side speaker 504*b*, and a television (TV) 506 in a first room space 512. The center piece 502, the first side speaker 504*a*, and the second side speaker 504*b* may be connected together as a sound bar speaker system in a 7.1 speaker configuration 508, as shown. There is further shown a user, such as a listener 510.

In accordance with the second exemplary scenario, the center piece 502 may correspond to the electronic device 102. The first side speaker 504*a* may correspond to the first sound reproduction device 104. The second side speaker 504*b* may correspond to the second sound reproduction device 106. The center piece 502 may be connected with the TV 506. The first side speaker 504*a* and the second side speaker 504*b* may be docked with the center piece 502 to form a single device or a single sound bar speaker system for a home theater, as shown.

In accordance with an embodiment, the first side speaker 504*a* and the second side speaker 504*b* may be dynamically connected with the center piece 502 to form a single device or a single sound bar speaker system for a home theater. The connection may be established to auto-configure the first side speaker 504*a*, the second side speaker 504*b*, and center piece 502 to function as a unified (one) full-size soundbar speaker system with the 7.1 speaker configuration 508. The connection among the first side speaker 504*a*, the second side speaker 504*b*, and center piece 502 in the 7.1 speaker configuration 508 may be a magnetic connection, a physical connection with pins, a proximity-detection based connection in the wireless network 108. Notwithstanding, it is to be understood that the establishment of connection among the first side speaker 504*a*, the second side speaker 504*b*, and center piece 502, may occur by use of other physical, wireless, or visible light communication (VLC) communication medium, such as Li-Fi. It may be determined that the three speakers, such as the first side speaker 504*a*, the second side speaker 504*b*, and center piece 502, may need to be auto-configured to the unified full-size soundbar speaker system with the 7.1 speaker configuration 508 after the connection is established.

The first side speaker 504*a* and the second side speaker 504*b* may include rechargeable batteries. The center piece 502 may be configured charge the rechargeable batteries of the first side speaker 504*a* and the second side speaker 504*b* when the first side speaker 504*a* and the second side speaker 504*b* are docked with the center piece 502. A surround sound mode may be automatically set when the first side speaker 504*a* and the second side speaker 504*b* are docked with the center piece 502.

The center piece 502 may be connected to the TV 506 which may be the audio source. The listener 510 may want to listen a song in the surround sound mode in the first room space 512. The song received from the TV 506 may be reproduced in the 7.1 speaker configuration 508 in the first room space 512. The 7.1 speaker configuration 508 may correspond to the third speaker configuration 114. In accordance with an embodiment, all the three pieces, such as the center piece 502, the first side speaker 504*a*, and the second side speaker 504*b* may be separated but still may work together in various other configurations.

With reference to FIG. 5B, there is shown the center piece 502, the first side speaker 504*a*, and the second side speaker 504*b* as separate devices in the 7.1 speaker configuration 508 in the first room space 512. The center piece 502 may be placed below the TV 506. The detachable speakers, such as the first side speaker 504*a* and the second side speaker 504*b*, may be moved behind the listener 510 to provide an enhanced surround sound effect in the surround sound mode.

In accordance with an embodiment, the center piece 502 may detect the first side speaker 504*a* and the second side speaker 504*b* within the pre-defined range of the center piece 502. The center piece 502 may connect to the first side speaker 504*a* and the second side speaker 504*b*, by use of the Wi-Fi communication protocol in the wireless network 108. The center piece 502 may communicate a calibration setting to the first side speaker 504*a* based on the then position of the first side speaker 504*a* in the first room space 512. The center piece 502 may communicate another calibration setting to a second side speaker 504*b* based on the then position of the second side speaker 504*b* in the first room space 512.

In accordance with an embodiment, the first side speaker 504*a* and the second side speaker 504*b* may configure automatically to their new positions in the first room space 512. The automatic configuration may be based on the received calibration settings from the center piece 502. The received calibration settings may be the best settings for their new positions in the first room space 512. The center piece 502 may perform a first audio calibration in the 7.1 speaker configuration 508. The first calibration may be based on the then position of the first side speaker 504*a* and the second side speaker 504*b*. The first side speaker 504*a*, the second side speaker 504*b*, and the center piece may function as a unified multi-channel audio system, such as the 7.1 speaker configuration 508.

In accordance with an embodiment, the center piece 502 may communicate the song received from the TV 506 to the first side speaker 504*a* and the second side speaker 504*b* in the 7.1 speaker configuration 508. The song received from the TV 506 may be reproduced by all speakers in the 7.1 speaker configuration 508 in the first room space 512 under the control of the center piece 502.

With reference to FIG. 5C, there is shown the first room space 512, a second room space 514, a third room space 516. There is further shown the center piece 502, the first side speaker 504*a*, the second side speaker 504*b*, the TV 506, and the listener 510. The first side speaker 504*a* may include a display 518 that may render a UI 520. The display 518 may correspond to the display screen 310 (FIG. 3). The UI 520 may correspond to the UI 312 (FIG. 3). The listener 510 may move the first side speaker 504*a* to the second room space 514, such as an outside patio of the home. The second side speaker 504*b* may be moved to the third room space 516, such as a kitchen of the home.

In accordance with an embodiment, the center piece 502 may detect absence of the first side speaker 504*a* and the second side speaker 504*b* in the first room space 512 in the 7.1 speaker configuration 508. The center piece 502 may further detect the change in position of the first side speaker 504*a* from the first room space 512 to the second room space 514. Similarly, the center piece 502 may also detect the change in position of the second side speaker 504*b* from the first room space 512 to the third room space 516.

In accordance with an embodiment, the center piece 502 may communicate a second calibration setting to each of the first side speaker 504*a* and the second side speaker 504*b*. The communication may occur by use of the Wi-Fi communication protocol in the wireless network 108 (FIG. 1). The center piece 502 may perform a second audio calibration in the 7.1 speaker configuration 508. The speaker configuration, as described in FIG. 5C, provides a multi-room sound for the home, in the 7.1 speaker configuration 508. It may enable all the speakers, such as the center piece 502, the first side speaker 504*a* and the second side speaker 504*b*, to play the same music in the 7.1 speaker configuration 508.

In accordance with an embodiment, the first side speaker 504*a* may be disconnected from the center piece 502. The center piece 502 may perform an auto-reconfiguration with the second side speaker 504*b*. The center piece 502 with the second side speaker 504*b* may be auto-reconfigured to a 6.1 speaker configuration (not shown). In such an embodiment, the first side speaker 504*a* in the second room space 514 may be configured to function as an independent speaker unit. The first side speaker 504*a* may display a list of one or more songs on the display 518 via the UI 520. The listener 510 may select a song from the UI 520 to be reproduced at the first side speaker 504*a*. The display of the list of one or more songs may be based on the audio and/video items pre-stored at the first side speaker 504*a*. The display of the list of one or more songs may be further based on other audio sources connected to the first side speaker 504*a*, as described in FIG. 3.

In accordance with an embodiment, the second side speaker 504*b* may also be disconnected from the center piece 502. In such a scenario, the center piece 502 may be auto-reconfigured to operate as a 5.1 speaker configuration. Thus, the disclosed auto-configurable system may be an advanced sound bar speaker system in the 7.1 speaker configuration 508, as shown in FIG. 5A. Thus, a user may purchase one advanced speaker system, such as the sound bar speaker system in the 7.1 speaker configuration 508, which enables various speaker configurations by use of the same speaker system.

Figure 6A:
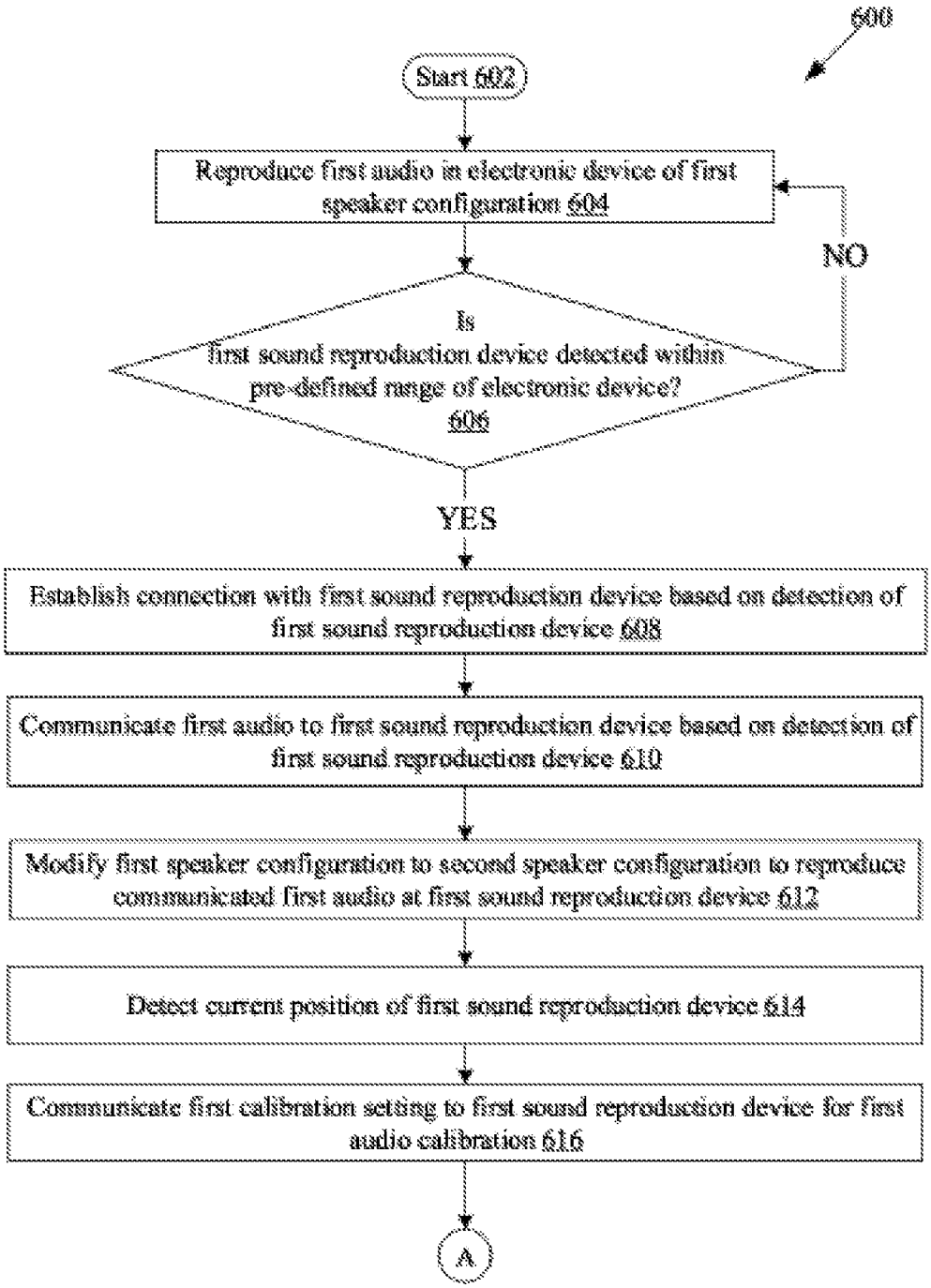
FIGS. 6A, 6B, and 6C, collectively, illustrate a flow chart for implementation of an exemplary method for auto-configuration of a speaker system, in accordance with an embodiment of the disclosure.
Figure 6B:
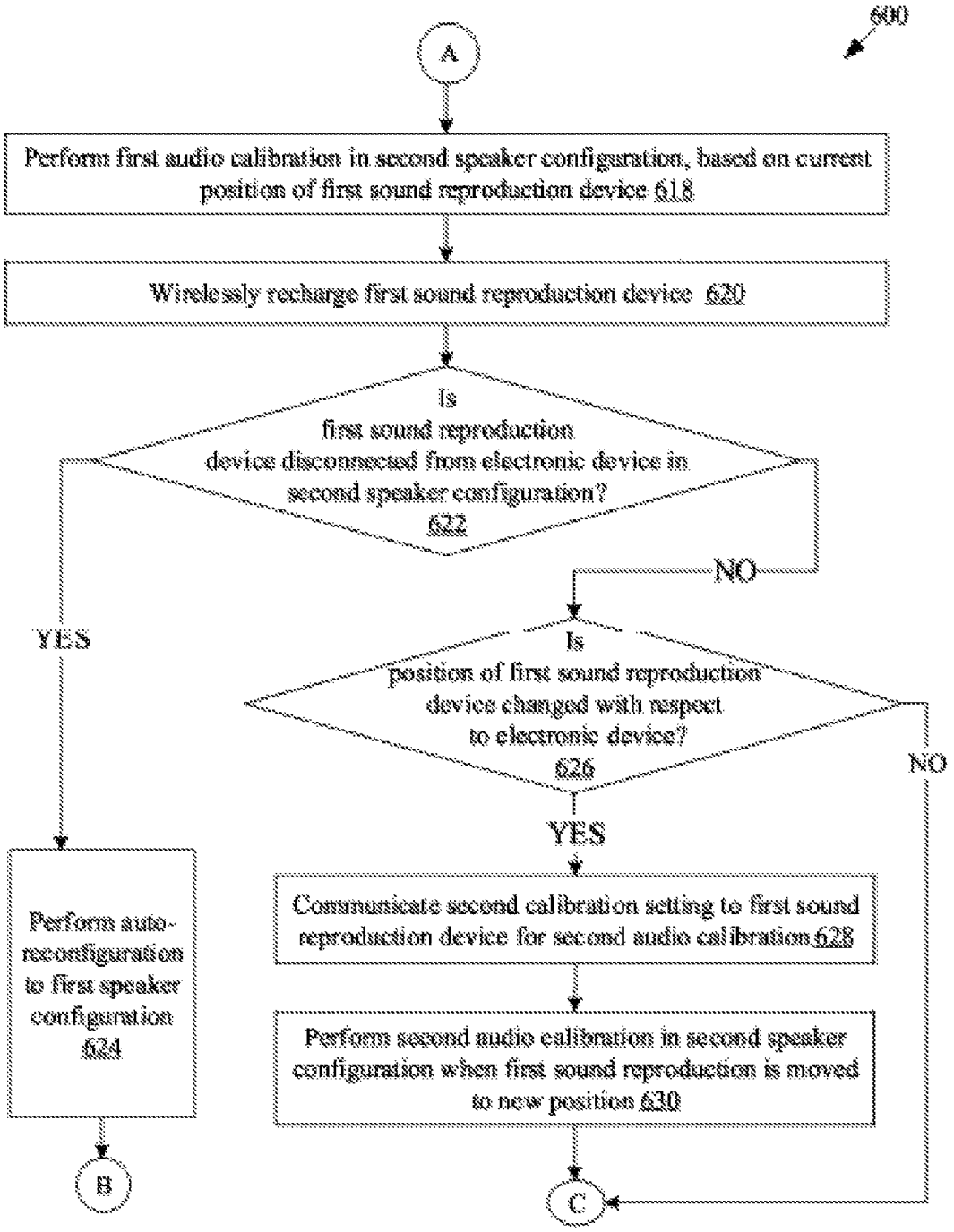
Figure 6C:
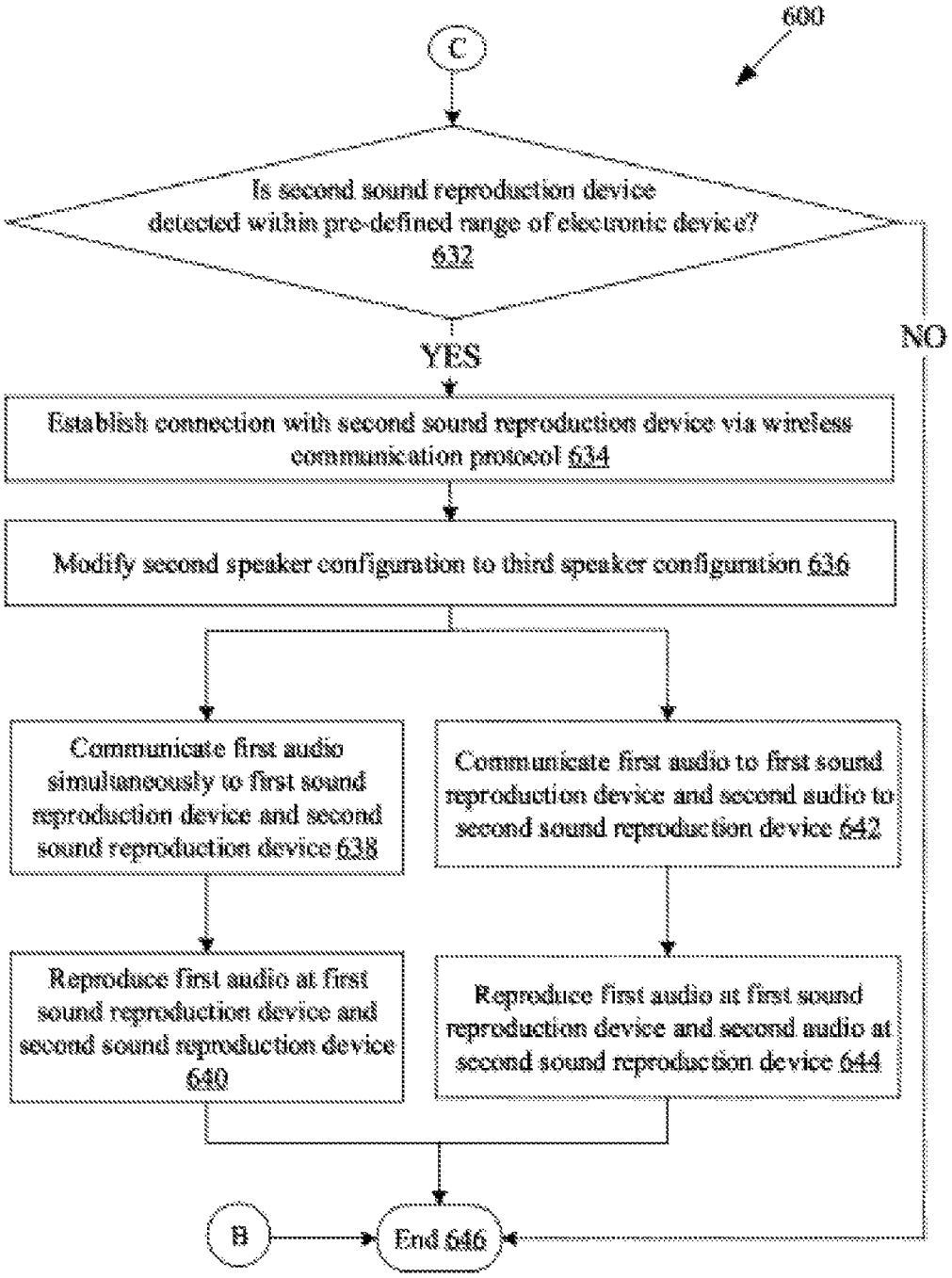

FIGS. 6A, 6B, and 6C, collectively, illustrate a flow chart for implementation of an exemplary method for auto-configuration of a speaker system, in accordance with an embodiment of the disclosure. With reference to FIGS. 6A, 6B, and 6C, there is shown a flow chart 600. The flow chart 600 is described in conjunction with elements from FIGS. 1, 2, 3, 4A, 4B, and 5A to 5C. The method starts at step 602 and proceeds to step 604.

At step 604, a first audio may be reproduced by the electronic device 102 in the first speaker configuration 110. Examples of the electronic device 102 may be the central control device 402 (FIGS. 4A and 4B) and the center piece 502 (FIGS. 5A to 5C). At step 606, it may be detected whether the first sound reproduction device 104 is present within a pre-defined range of the electronic device 102. Examples of first sound reproduction device 104 may be the first speaker 404 (FIGS. 4A and 4B) or the first side speaker 504*a* (FIGS. 5A to 5C). In instances when the first sound reproduction device 104 is detected within the pre-defined range of the electronic device 102, the control may pass to step 608. In instances when the first sound reproduction device 104 is not detected within the pre-defined range of the electronic device 102, the control may pass back to step 604.

At step 608, a connection may be established between the electronic device 102 and the first sound reproduction device 104, via a wireless communication protocol. The connection of the electronic device 102 with the first sound reproduction device 104 may be based on the detection of the first sound reproduction device 104. At step 610, a first audio may be communicated to the first sound reproduction device 104 by the electronic device 102. The communication of the first audio to the first sound reproduction device 104 may be based on the established connection.

At step 612, the first speaker configuration 110 may be modified to the second speaker configuration 112 by the electronic device 102. The first speaker configuration 110 may be modified to reproduce the first audio at the first sound reproduction device 104 in the second speaker configuration 112. At step 614, a current position of the first sound reproduction device 104 may be detected by the electronic device 102. For instance, the current position may be the position of the first sound reproduction device 104 with respect to the electronic device 102 in the first room space 512.

At step 616, a first calibration setting may be communicated to the first sound reproduction device 104, by the electronic device 102, for a first audio calibration. At step 618, a first audio calibration may be performed in the second speaker configuration 112, by the electronic device 102. The first audio calibration may be based on the current position of the first sound reproduction device 104.

At step 620, the first sound reproduction device 104 may be wirelessly recharged by the electronic device 102. The first sound reproduction device 104 may include the rechargeable power bank. At step 622, it may be determined whether the first sound reproduction device 104 is disconnected from the electronic device 102 in the second speaker configuration 112. The disconnection of the first sound reproduction device 104 from the electronic device 102 may be based on the movement of the first sound reproduction device 104 beyond the pre-defined range of the electronic device 102 or based on a user input. In instances when the first sound reproduction device 104 is disconnected from the electronic device 102, the control may pass to the step 624. In instances when the first sound reproduction device 104 is not disconnected from the electronic device 102, the control may pass to step 626.

At step 624, an auto-reconfiguration may be performed by the electronic device 102 to first speaker configuration 110. The control passes to end step 646 (FIG. 6C). At step 626, it may be determined whether there is a change in position of the first sound reproduction device 104 with respect to the electronic device 102. In instances, when there is a change in position of the first sound reproduction device 104 with respect to the electronic device 102, the control passes to step 628. In instances, when there is no change in position of the of the first sound reproduction device 104 with respect to the electronic device 102, the control may pass to step 632.

At step 628, a second calibration setting may be communicated, by the electronic device 102, to the first sound reproduction device 104 for second audio calibration. At step 630, the second audio calibration may be performed in the second speaker configuration 112. The second audio calibration may be based on the new position of the first sound reproduction device 104 with respect to the electronic device in the same room space (such as the first room space 512), or a second room space (such as the second room space 514).

At step 632, it may be detected whether the second sound reproduction device 106 is present within the pre-defined range of the electronic device 102. In instances when the second sound reproduction device 106 is detected within the pre-defined range of the electronic device 102, the control may pass to step 634. Examples of the second sound reproduction device 106 may be the second speaker 412 (FIGS. 4A and 4B) or the second side speaker 504*b* (FIGS. 5A to 5C). In instances when the second sound reproduction device 106 is not detected within the pre-defined range of the electronic device 102, the control may pass to the end step 646 or may pass back to the step 620 to continue to operate in the second speaker configuration 112.

At step 634, a connection may be established between the electronic device 102 and the second sound reproduction device 106, via a wireless communication protocol. The connection may occur based on the detection of the second sound reproduction device 106 within the pre-defined range of the electronic device 102. In accordance with an embodiment, the detection of the second sound reproduction device 106 may occur as and when the second sound reproduction device 106 is detected, irrespective of the ordering of the steps of the flow chart 600. At step 636, the second speaker configuration 112 may be modified to the third speaker configuration 114, by the electronic device 102. The control may pass to step 638 or step 642 based on a pre-defined setting or a user input.

At step 638, the first audio may be simultaneously communicated, by the electronic device 102, to the first sound reproduction device 104 and the second sound reproduction device 106. At step 640, the first audio may be reproduced at the first sound reproduction device 104 and/or the second sound reproduction device 106. The control may then pass to the end step 646.

At step 642, the first audio may be communicated to the first sound reproduction device 104 and a second audio may also be communicated to the second sound reproduction device 106. At step 644, the first audio may be reproduced at the first sound reproduction device 104 and the second audio may be reproduced at the second sound reproduction device 106. The control may pass to the end step 646.

In accordance with an embodiment of the disclosure, a speaker system is disclosed. The speaker system may include the electronic device 102 (FIG. 1), which may comprise one or more circuits (hereinafter referred to as the processor 202 (FIG. 2)). The processor 202 may be configured to reproduce a first audio in the first speaker configuration 110. The processor 202 may be further configured detect the first sound reproduction device 104 within a pre-defined range of the electronic device 102. The processor 202 may be further configured to communicate the first audio to the first sound reproduction device 104, based on the detection. The processor 202 may be further configured to modify the first speaker configuration 110 to the second speaker configuration 112 to reproduce the communicated first audio at the first sound reproduction device 104.

Various embodiments of the disclosure may provide a non-transitory computer readable medium and/or storage medium, wherein there is stored thereon, a set of instructions executable by a machine and/or a computer for auto-configuration of a speaker system. The set of instructions may cause the machine and/or computer to perform the steps that comprise reproduction of a first audio by the electronic device 102 in the first speaker configuration 110. A first sound reproduction device 104 within a pre-defined range of the electronic device 102, may be detected. The first audio may be communicated to the first sound reproduction device 104 based on the detection. The first speaker configuration 110 may be modified to the second speaker configuration 112 to reproduce the communicated first audio at the first sound reproduction device 104.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted to carry out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features that enable the implementation of the methods described herein, and which when loaded in a computer system is able to carry out these methods. Computer program, in the present context, means any expression, in any language, code or notation, of a set of instructions intended to cause a system with an information processing capability to perform a particular function either directly, or after either or both of the following: a) conversion to another language, code or notation; b) reproduction in a different material form.

While the present disclosure has been described with reference to certain embodiments, it will be understood by those skilled in the art that various changes may be made and equivalents may be substituted without departure from the scope of the present disclosure. In addition, many modifications may be made to adapt a particular situation or material to the teachings of the present disclosure without departure from its scope. Therefore, it is intended that the present disclosure not be limited to the particular embodiment disclosed, but that the present disclosure will include all embodiments that fall within the scope of the appended claims.

What is claimed is:

1. A speaker system, comprising:

circuitry in an electronic device configured to reproduce a first audio in a first speaker configuration, said circuitry is further configured to:

detect a first sound reproduction device within a range of said electronic device;

communicate said first audio to said first sound reproduction device based on said detection of said first sound reproduction device;

modify said first speaker configuration to a second speaker configuration to reproduce said communicated first audio at said first sound reproduction device; and automatically transmit, based on a detection of a change in position of said first sound reproduction device with respect to said electronic device, a second calibration setting to said first sound reproduction device.

2. The speaker system according to claim 1,
wherein said electronic device corresponds to one of a central speaker, a sound bar, or a central control device, and
wherein said first sound reproduction device corresponds to one of a side speaker, a digital speaker, a loudspeaker, or a portable sound reproduction device.

3. The speaker system according to claim 1,
wherein said first speaker configuration corresponds to a first multi-channel audio system configuration and said second speaker configuration corresponds to a second multi-channel audio system configuration.

4. The speaker system according to claim 1,
wherein said circuitry is further configured for a first audio calibration in said second speaker configuration based on a first position of said first sound reproduction device, and
wherein a first calibration setting is communicated to said first sound reproduction device for said first audio calibration.

5. The speaker system according to claim 1,
wherein said circuitry is further configured for a second audio calibration in said second speaker configuration based on said second calibration setting.

6. The speaker system according to claim 5,
wherein said change in position corresponds to a movement of said first sound reproduction device from said first position to a second position with respect to said electronic device in a first room space.

7. The speaker system according to claim 5,
wherein said change in position corresponds to a movement of said first sound reproduction device from said first position to a second position,
wherein said first position is at a first room space and said second position is at a second room space, and
wherein said first sound reproduction device and said electronic device function as a unified multi-channel audio system based on said second audio calibration.

8. The speaker system according to claim 1,
wherein said circuitry is further configured to automatically connect to said first sound reproduction device via a wireless communication protocol based on said detection of said first sound reproduction device within said range of said electronic device.

9. The speaker system according to claim 1,
wherein said circuitry is further configured to connect to a second sound reproduction device via a wireless communication protocol based on a detection of said second sound reproduction device within said range of said electronic device.

10. The speaker system according to claim 9,
wherein said circuitry is further configured to concurrently communicate said first audio to said first sound reproduction device and said second sound reproduction device, and
wherein said second speaker configuration is modified to a third speaker configuration to reproduce said communicated first audio at said first sound reproduction device and said second sound reproduction device.

11. The speaker system according to claim 9,
wherein said circuitry is further configured to communicate said first audio to said first sound reproduction device and a second audio to said second sound reproduction device, and
wherein said second speaker configuration is modified to a third speaker configuration to reproduce said communicated first audio at said first sound reproduction device and said second audio at said second sound reproduction device.

12. The speaker system according to claim 1,
wherein said circuitry is further configured to auto-reconfigure said first speaker configuration based on a disconnection of said first sound reproduction device from said electronic device.

13. The speaker system according to claim 1,
wherein said circuitry is further configured to wirelessly recharge said first sound reproduction device, and
wherein said first sound reproduction device comprises a rechargeable power bank.

14. A method for auto-configuration of a speaker system, said method comprising:
reproducing, by an electronic device, a first audio in a first speaker configuration;
detecting, by said electronic device, a first sound reproduction device within a range of said electronic device;
communicating, by said electronic device, said first audio to said first sound reproduction device based on said detection;
modifying, by said electronic device, said first speaker configuration to a second speaker configuration to reproduce said communicated first audio at said first sound reproduction device; and
automatically transmitting, based on a detection of a change in position of said first sound reproduction device with respect to said electronic device, a second calibration setting to said first sound reproduction device.

15. The method according to claim 14, further comprising a first audio calibration, by said electronic device, in said second speaker configuration based on a first position of said first sound reproduction device, wherein a first calibration setting is communicated to said first sound reproduction device for said first audio calibration.

16. The method according to claim 14, further comprising a second audio calibration, by said electronic device, in said second speaker configuration based on said second calibration setting.

17. The method according to claim 14, further comprising connecting, by said electronic device, to said first sound reproduction device via a wireless communication protocol based on said detection of said first sound reproduction device within said range of said electronic device.

18. The method according to claim 14, further comprising connecting, by said electronic device, to a second sound reproduction device via a wireless communication protocol based on a detection of said second sound reproduction device within said range of said electronic device.

19. The method according to claim 18, further comprising communicating, by said electronic device, said first audio to said first sound reproduction device and said second sound reproduction device, wherein said second speaker configuration is modified to a third speaker configuration to reproduce said communicated first audio at said first sound reproduction device and said second sound reproduction device.

20. The method according to claim 14, further comprising an auto-reconfiguration, by said electronic device, of said first speaker configuration based on a disconnection of said first sound reproduction device from said electronic device.

* * * * *